US005896611A

United States Patent [19]

Haaga

[11] Patent Number: 5,896,611

[45] Date of Patent: Apr. 27, 1999

[54] SWEEPING MACHINE

[75] Inventor: Hermann Haaga, Kircheim/Teck, Germany

[73] Assignee: Ing. Haaga Werkzeugbau KG, Kircheim/Teck, Germany

[21] Appl. No.: 08/839,808

[22] Filed: Apr. 18, 1997

[30] Foreign Application Priority Data

May 4, 1996 [DE] Germany ..... 196 17 986

[51] Int. Cl.[6] ..... A47L 11/22; A47L 11/24

[52] U.S. Cl. ..... 15/42; 15/52.1; 15/79.1

[58] Field of Search ..... 15/41.1, 42, 49.1, 15/78, 79.1, 82, 83, 87

[56] References Cited

U.S. PATENT DOCUMENTS

| | | | |
|---|---|---|---|
| 500,976 | 7/1893 | Tangenberg | 15/42 |
| 2,178,917 | 11/1939 | Pullen | 15/41.1 |
| 2,657,408 | 11/1953 | Machovec | 15/83 |
| 4,502,173 | 3/1985 | Patzold et al. | 15/41.1 |
| 4,709,436 | 12/1987 | Berfield et al. | 15/41.1 |
| 5,806,123 | 9/1998 | Tono | 15/49.1 |

FOREIGN PATENT DOCUMENTS

| | | | |
|---|---|---|---|
| 3605235 | 8/1987 | Germany | 15/41.1 |

*Primary Examiner*—Terrence R. Till
*Attorney, Agent, or Firm*—Evenson McKeown Edwards & Lenahan, PLLC

[57] ABSTRACT

A sweeping machine has two circular brooms at the front region of a housing rotating towards the inside in opposing directions. Inside the housing and adjoining a sweeper plate across which the circular brooms sweep, a cylinder broom sweeping in a direction towards the front region is arranged. The cylinder broom picks up the refuse swept by the circular brooms and sweeps up dusty refuse in particular from the ground and throws both of these together backwards into the housing into a refuse container.

28 Claims, 2 Drawing Sheets

SWEEPING MACHINE

BACKGROUND AND SUMMARY OF THE INVENTION

This application claims the priority of German application 196 17 986.6 filed in Germany on May 4, 1996.

The invention relates to a sweeping machine, with a housing incorporating a refuse collection container, which has at its front area, rotating in opposite directions towards the inside and about forwardly inclined rotatable axles, two circular brooms sweeping across a sweeper plate inside the housing which extends back up to the refuse collection container.

Manually operated sweeping machines of this type (German Patent Document DE 41 01 888 A1) have the merit of being simple in construction and they operate efficiently. They offer considerable advantages, particularly when sweeping up coarse rubbish and leaves.

Manually operated or push-operated sweeping machines are also known which have a cylinder broom, or two arranged one behind the other, extending transversely across the width of the sweeping machine. If two cylinder brooms are provided, the two cylinder brooms are so driven that the first one sweeps away from the front region and the second one sweeps in the opposing direction, whereby the second one hurls the sweepings into a refuse collection container arranged thereafter. With this type of sweeping machine, another known system is to arrange a circular broom on one or both sides in the front region of the housing in front of the cylinder broom or brooms, sweeping inwards so as to carry the rubbish to be picked up to the area which is being swept by the cylinder brooms.

An underlying objective of the invention is to provide a sweeping machine of the type outlined above, which sweeps more efficiently and can be used for all purposes, in particular for sweeping finer refuse.

This objective is achieved according to preferred embodiments of the invention by the fact that a cylinder broom sweeping in the direction towards the front region is arranged behind the circular brooms and the bristles thereof adjoin the sweeper plate and a refuse collection container is arranged on the side facing away from the sweeper plate.

In the sweeping machine of the invention, the circular brooms pick up the coarser refuse in the central area where these collide or where a only short distance is retained between them, and sweep it across the sweeper plate towards the interior of the housing. Finer sweepings, for example fine, dry dust, are swept into the central region and then picked up by the cylinder broom arranged behind. The cylinder broom arranged behind the circular brooms therefore takes control of the rubbish swept by the circular brooms across the sweeper plate towards the inside, accelerating it such that it is thrown upwards and backwards into the refuse collection container. This system therefore also offers the possibility of being able to carry coarse rubbish and leaves, for example, far back into the refuse collection container, which means that a high-volume refuse collection container can be used which can be filled "from the back forwards". The capacity of the refuse collection container is improved as a result.

The design of preferred embodiments of the invention is such that an essentially part cylindrical guide wall is provided for the cylinder broom, the upper end of which adjoins the end of the sweeper plate facing towards the cylinder broom. In conjunction with the bristles of the cylinder broom, this guide wall forms a relatively narrow passage of a few millimeters so that the risk of the dust swept up by the cylinder broom being swirled or blown away is relatively low.

In another aspect of preferred embodiments of the invention, the end of the sweeper plate facing towards the cylinder broom is provided with an upwardly bent end portion, oriented somewhat at a tangent to the external circumference of the bristles of the cylinder broom. By dint of this end portion, the sweepings conveyed by the circular brooms across the sweeper plate do not penetrate the cylinder broom too deeply and can be readily released therefrom.

In yet another aspect of preferred embodiments of the invention, the circular brooms and their bristles extend out beyond the end of the sweeper plate into the region of the bristles of the cylinder broom. Consequently, the cylinder broom fulfills another function, namely that of cleaning the bristles of the circular brooms.

Another aspect of preferred embodiments of the invention is a design configured so that the axial length of the cylinder broom is smaller than the distance between the rotatable axles of the circular brooms, preferably about 30% smaller. On the one hand, a cylinder broom of this type is not as expensive to provide and, on the other, it is perfectly adequate for picking up any refuse, particularly fine, dry dust, left behind between the circular brooms and not yet picked up thereby. In these embodiments, cross-walls are provided in the region of the two end faces of the cylinder broom extending in the longitudinal direction of the housing, each of these being located above a circular broom. The effect of these cross-walls is that the greater proportion of the sweepings moved by the circular brooms reaches the area of the cylinder broom, where they are picked up and accelerated thereby. The cross-walls offer an additional advantage in that, together with the respective external walls of the housing, they form an air passage which conveys air forwards towards the circular brooms which then push it back into the housing. A large proportion of the air is therefore fed back into the housing by means of the circular brooms, so that the risk of dry dust escaping to the exterior or being blown out by the sweeping machine is very greatly reduced.

Another aspect of preferred embodiments of the invention is a design configured so that the bristles of the cylinder broom consist of several tufts of bristles. Between them, the tufts of bristles form pockets, in which the sweepings from the circular brooms are picked up, carried along with a short portion of the circumference and then flung off.

In another aspect of preferred embodiments, the tufts of bristles are so designed that they are respectively formed by sets of at least two portions, inclined with respect to an external contour of the cylinder broom, which meet more or less in the center of the cylinder broom. This arrangement ensures that the bristles of the cylinder broom are well distributed across the circumference of the cylinder broom so that more or less the same number of bristles is always in contact with the floor being swept.

In another aspect of preferred embodiments of the invention, the housing is provided with wheels in the region facing away from the circular brooms, and these provide the driving motion for the cylinder broom. With this system, the broom is driven by the directional movement of the sweeping machine, which means that there is no need to provide a drive motor or similar drive device.

Other features and advantages of the invention will become clear from the following description of embodiments illustrated in the appended drawings.

DETAILED DESCRIPTION OF THE DRAWINGS

Figure 1:
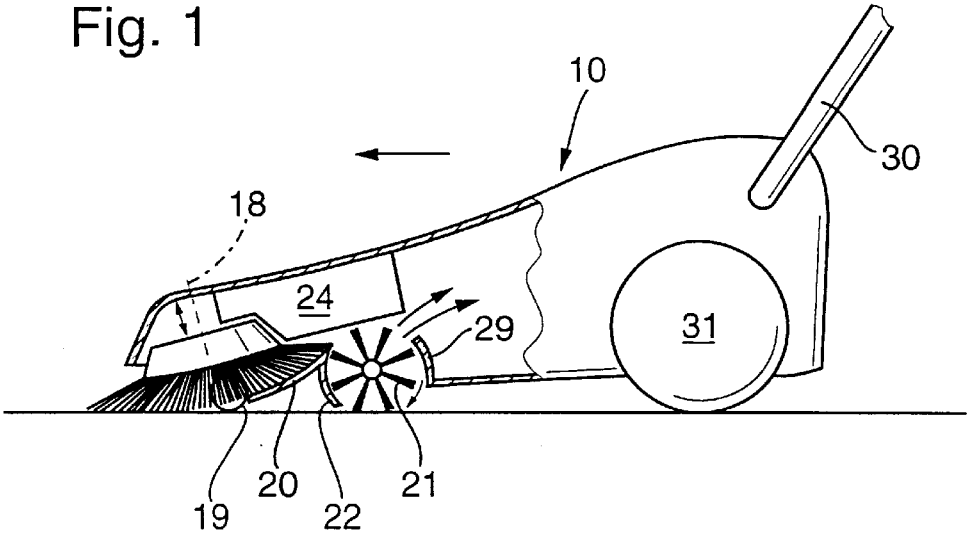
FIG. 1 shows a side view of a sweeping machine constructed according to a preferred embodiment of the invention, taken from a front region in a section approximately through the longitudinal plane.
Figure 2:
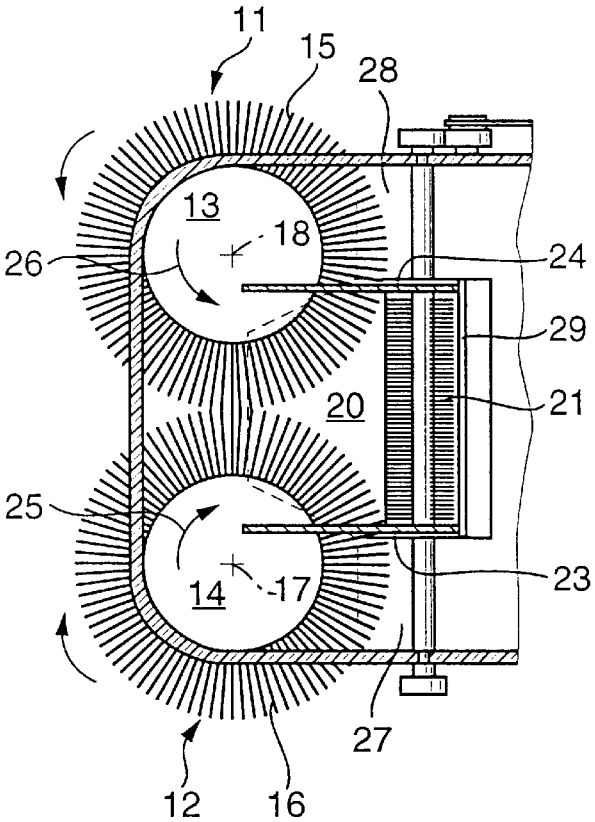
FIG. 2 is a partial section viewed from above of the front region of the sweeping machine FIG. 1.

The sweeping machine illustrated in FIGS. 1 and 2 has a housing (10), which is preferably made from plastics components. At its front region, this housing (10) is provided with two circular brooms (11, 12) which consist of a bowl-shaped body (13, 14) provided with one or more rows of bristles (15, 16) on the essentially downwardly pointing rim thereof. The circular brooms (11, 12), whose bristles (15, 16) come into contact with one another in the longitudinal center of the sweeping machine, rotate about forwardly inclined axles (17, 18) set at an angle. The actual bristles (15, 16) themselves are straight. Due to the rotation of the circular brooms (11,12), they are able to assume the somewhat backwardly bent shape illustrated, although this has been somewhat exaggerated in the diagram of FIGS. 1 and 2.

The rotatable axles (17, 18) of the circular brooms (11, 12) are inclined forwards at an angle of about 10° relative to the vertical so that the frontmost third of the circumference of the bristles (15, 16) of the circular brooms (11, 12) is in contact with the ground to be swept. The bowl-shaped bodies (13, 14) of the circular brooms (11, 12) are rotatably mounted in the housing (10), in particular in the manner as known from and disclosed in German Patent Document DE-A 41 01 888. The circular brooms (11, 12) are driven in such a way that they rotate in opposing directions and sweep the rubbish at the front region of the sweeping machine from the outside towards the inside. By preference, the circular brooms (11, 12) are driven in the manner known from German Patent Documents DE-C 22 62 648 or DE-A 36 05 235. To this end, guiding rollers (19) are arranged within the circular brooms, which drive the circular brooms so that they sweep from the outside towards the inside irrespective of the direction of travel, as indicated by the arrows in FIG. 2.

The circular brooms (11, 12) sweep the refuse across a sweeper plate (20) rising back at an angle towards the interior of the housing. The sweeper plate (20) runs essentially plumb with the rotatable axles (17, 18).

Arranged to the rear of the sweeper plate (20) is a cylinder broom (21), the axial length of which is shorter than the distance between the rotatable axles (17, 18). The cylinder broom (21), which provides a sweeping action across the ground to be swept, is so driven that it sweeps towards the front region of the housing. The cylinder broom (21) operates in conjunction with an essentially part-cylindrical guide wall (22), the upper end of which adjoins the end of the sweeper plate (20). The cylinder broom (21) has several functions. On the one hand, the cylinder broom (21) picks up the sweepings conveyed by the circular brooms (11, 12) across the sweeper plate (20), accelerates these and throws them out to the rear region of the housing (10), serving as a refuse container. On the other hand, the cylinder broom (21) sweeps the ground to be cleaned in the central area of the sweeping machine, i.e. in the area between the circular brooms (11, 12). It is the cylinder broom (21) in particular which picks up fine refuse that has been swept back by the circular brooms (11, 12) into the central area of the sweeping machine and not yet carried across the sweeper plate (20). This part of the sweepings is picked up by the cylinder broom (21), which also flings it backwards into the part of the housing (10) used as a refuse collection container. As may be seen from FIG. 2 in particular, the bristles (15, 16) of the circular brooms (11, 12) extend into the area of the cylinder broom (21), so that the cylinder broom (21) brushes off and cleans the bristles (15, 16) of the circular brooms (11, 12) inside the housing (10). This function can be improved if the cylinder broom (21) is brought closer to the rotatable axles (17, 18) so that there is an even bigger overlap between the bristles (15, 16) of the circular brooms (11, 12) and the cylinder broom (21). Due to the fact that, in the normal direction of travel, the cylinder broom (21) follows the circular brooms (11, 12) and picks of the sweepings left behind by these, the sweeper plate (20) may be kept to a relatively short design and may be spaced at a relatively large distance from the ground. In the extreme case, the sweeper plate may be reduced to virtually the end portion (38) (see FIG. 5), particularly if the circular brooms are provided with several rows of bristles (15, 16).

Arranged in the area of the end faces of the cylinder broom (21) are cross-walls (23, 24), which extend essentially in the longitudinal direction of the housing (10), i.e. in the direction of travel. These cross-walls extend beyond the area of the circular brooms (11, 12) and are retained at a slight distance from these. The effect of the cross-walls (23, 24) is such that the refuse swept by the circular brooms (11, 12) can be safely guided to the area of the cylinder broom (21) and picked up thereby. In addition, the cross-walls (23, 24) form passages in conjunction with the respective side walls of the housing (10) extending forwards from the refuse container to the circular brooms (11, 12). The effect of this is that because of the way in which the circular brooms (11, 12) and the cylinder broom (21) operate, air is forcibly directed forwards into the housing (10) in the direction of the circular brooms (11,12), which then direct the greater part of this air back into the housing (10), as indicated by the arrows (25, 26). This has an added advantage in that rather than being blown outwards, the greater part of any dust-laden air is fed back into the interior of the housing (10). The chances of any dust that might be caught up in this air flow finally landing in the refuse container of the housing (10) are thereby significantly increased.

As can be seen particularly clearly from FIG. 2, pockets (27, 28) are provided to the side on the refuse container between the cross-walls (23, 24) and the respective side walls of the housing (10), across the upper rims of which the bristles (15, 16) of the circular brooms (11, 12) sweep. Any sweepings that might have been carried with the bristles (15, 16) of the circular brooms (11, 12) to the side and over the cross-walls (23, 24) can still be collected in these pockets (27, 28).

The rollers (19) driving the circular brooms (11, 12) are mounted in the front region of the housing (10) at an adjustable height, by preference in the manner known from German Patent Document DE-A 41 01 888. The front region of the housing (10) can be raised or lowered by adjusting the height of the roller (19) so that the contact pressure of the circular brooms (11, 12) and the cylinder broom (21) with the ground can be adjusted.

A stripper blade (29) for the cylinder broom (21) is arranged on the side of the sweeper plate (20) facing away therefrom, which extends into the bristles of the cylinder broom. In the transverse direction, the housing (10) is split into two parts, not illustrated in detail, which are detachably joined to one another. The front part incorporates the circular brooms (11, 12), the sweeper plate (20), the cylinder broom (21) including its mounting and the cross-walls (23, 24). The rear part of the housing (10), which basically serves as the refuse catchcontainer, starts with the stripper edge (29) and also incorporates the catch-pockets (27, 28). The rear part of the housing (10) is provided with a pushing arm (30) and with wheels (31). Once it has been released from the front part, the rear part serving as the refuse collection container can still be pushed away. Instead of a stripper edge, a rotating accelerator cylinder with bristles may be provided or alternatively a wide slit with a suction nozzle.

Figure 3:
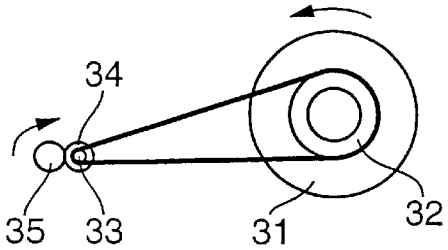
FIG. 3 illustrate an embodiment of a drive operated by the wheels of the sweeping machine for the cylinder broom of the sweeping machine of FIGS. 1 and 2, which is always driven in the same direction of rotation irrespective of the direction in which the sweeping machine is moving.

The driving force for the cylinder broom (21) is derived from the wheels (31). This system may be set up using a belt drive, as illustrated in FIG. 3. A belt pulley (32) is linked to at least one wheel (31), which drives a belt, in particular a circular belt, running across a pulley wheel (33), which is joined in rotation with a gear or friction wheel (34), which in turn drives a gear or friction wheel (35) linked to the shaft of the cylinder broom (21). When pushed in the standard forward direction, i.e. when the sweeping machine is operating with the front circular brooms (11, 12), the cylinder broom (21) is so driven that it sweeps across the ground in the direction opposite the direction of forward movement towards the front area. If the direction of movement of the sweeping machine is reversed, i.e. if the sweeping machine is pulled rather than pushed, the direction of rotation of the wheel (31) is reversed whilst the direction of rotation of the circular brooms (11, 12) remains the same. As long as the pulling movement does not continue over a particularly long distance, there should no problem if the cylinder broom (21) rotates in what is in effect the wrong direction. In order to prevent this direction of rotation from being changed, however, it is also possible to incorporate a freewheel in the drive, for example between the pulley wheel(33) and the gear or friction wheel (34). This would then ensure that the cylinder broom (21) does not rotate in the opposite direction. In view of the friction encountered with the ground to be swept, it is more likely to continue rotating in the direction in which it sweeps towards the front of the sweeping machine. This direction of rotation will also be assisted by the fact that the circular brooms (11, 12) are always rotating in the same direction and engage the cylinder broom (21) with their bristles, and therefore also exert a driving action in the "right" sweeping direction.

Provision can be made in a modified embodiment to ensure that the cylinder broom (21) always rotates in the "right" direction even if the direction of travel of the sweeping machine is reversed.

Figure 4:
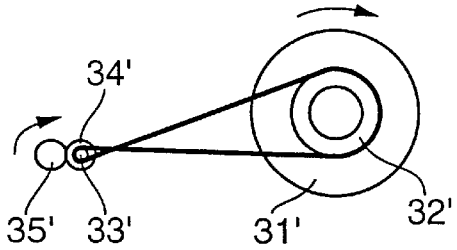
FIG. 4 is a view similar to FIG. 3 showing a drive operated by the wheels of the sweeping machine.

This can be so arranged, for example, that one of the wheels (31) is provided with the drive described in FIG. 3 whilst the other wheel (31') operates the cylinder broom (21) by means of a drive such as that of FIG. 4. In this case, the arrangement is such that the drive belt running round the belt pulley (32') and round the pulley wheel (33') is crossed so that the directions of rotation of the wheel (31') and drive wheel (34') are opposed. This being the case, it would also be practical to provide a freewheel, for example between the pulley wheel (33') and the drive wheel (34'), which in any event will lock in the direction opposite that of the freewheel of the drive of FIG. 3. In another modified embodiment, the same effect can be produced if the wheel (31') drives the belt pulley via an intermediate stage so that the latter will rotate in the direction opposite the wheel (31'). The sweeping machine of the invention makes provision so that the rotation speed of the wheels (31) will transmit speed to the cylinder broom (21), i.e. the cylinder broom (21) will rotate at a faster speed than the wheels (31). With these embodiments, this transmission is effected by means of the belt pulley. In practice, however, it would probably be preferable if this transmission were handled by gear stages.

Figure 5:
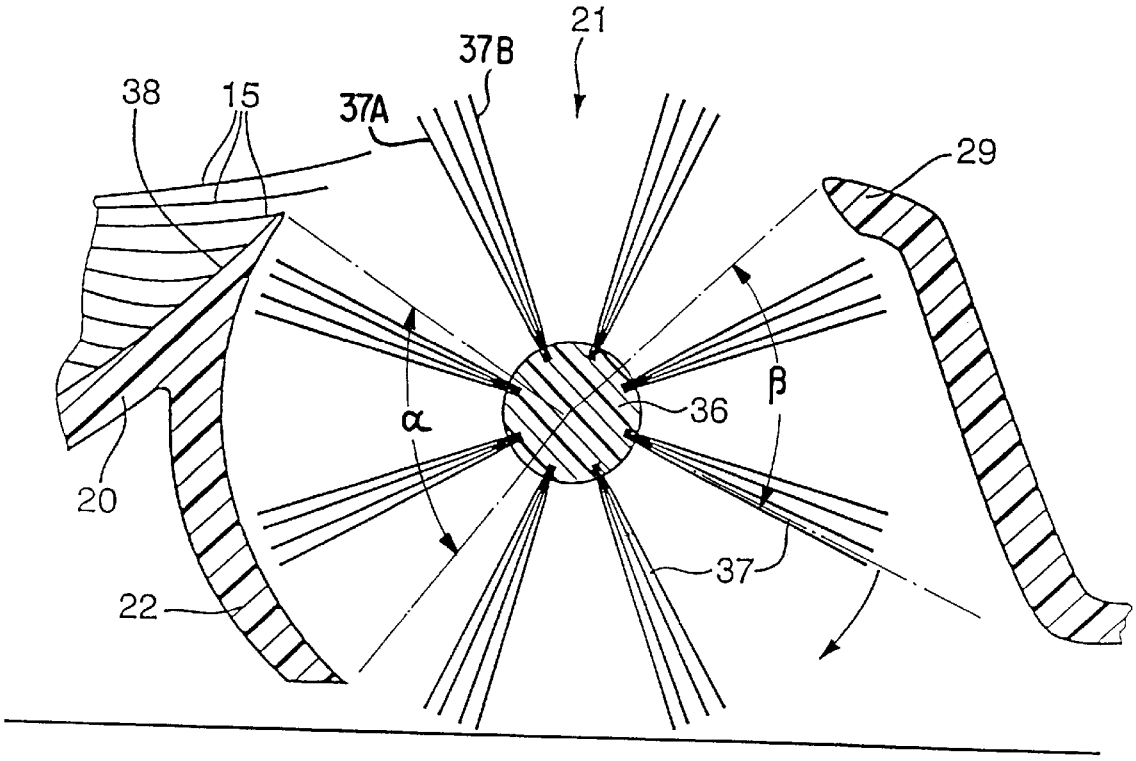
FIG. 5 is an enlarged cut-out view from FIG. 1 in the region of the cylinder broom and the elements cooperating therewith.

FIG. 5 shows an enlarged view of the area around the cylinder broom (21). The cylinder broom consists of an axial member (36), which is provided with bristles in the form of tufts of bristles (37). In this embodiment, these bristle tufts (37) run in line with the external contour of the axial member (36). In a modified embodiment, the tufts of bristles (37) are provided such that they consist of two sections 37A, 37B arranged on the axial member (36) in an arrow-shape. The two sections then run respectively at an angle to the contour of the axial member (36), so that they meet one another at the center. Because of this arrow-shaped design of the bristle tufts (37), the cylinder broom (21) can be constructed so that more or less the same number of bristles is always in contact with the ground. The part-cylindrical guide wall (22) is arranged at a distance of a few millimeters, for example 3 mm, from the circumference of the bristle tufts (37). Consequently, the dust that is swept along is carried upwards by the cylinder broom (21) with only minimal swirling effect. The guide wall (22) extends so far upwards that it subtends an angle $\alpha$ of some 45° relative to the horizontal above the axis of the cylinder broom (21). In preferred contemplated embodiments this angle $\alpha$ is between 30° to 50° . The lower end sits at a distance of some 10 mm or less above the ground. The upper end of the guide wall (22) extends over the sweeper plate (20), across which the bristles (15, 16) of the circular brooms (11, 12) sweep. At least in the area of the end faces of the cylinder broom (21), these bristles (15, 16) extend into the area of the bristle tufts (37) of the cylinder broom (21), which is at least partially cleaned out by these. The sweeper plate (20) has an end portion (38) which is bent upwards opposite the effectively flat sweeper plate (20) such that it extends somewhat at a tangent to the circumference of the tufts of bristles (37) of the cylinder broom (21). Consequently, the sweepings moved along by the circular brooms (11, 12) do not penetrate the pockets between the tufts of bristles (37) of the cylinder broom (21) too deeply, and are easily flung back off these. In the area behind the sweeper plate (20), the cylinder broom (21) has an inherent element of motion which is directed backwards into the refuse collector of the housing (10). The layout of the drive of the cylinder broom (21) illustrated in FIGS. 3 and 4 is such that the rotation speed of the wheels (31, 31') is so transmitted that the cylinder broom (21) is rotated at a higher rotation speed than the speed at which the wheels (31, 31') rotate.

Provided on the oppositely lying face of the sweeper plate (20) is a stripper blade (29), which sits at more or less the same height as the end portion (38) of the sweeper plate (20). The end of the stripper blade (29) extends onto the area of the external circumference of the tufts of bristles (37) so that any refuse that is still clinging to the bristle tufts (37) or that has not yet been flung off, is stripped off. Since the external diameter of the cylinder broom (21) is in a range of 115 mm to 145 mm, and preferably 130 mm in the area of the ends of the tufts of bristles (37), the stripper blade (29) lies at a corresponding distance above the ground so that there is still room for a large-volume refuse container in the area of the stripper blade (29). In preferred embodiments, the stripper blade (2) subtends an angle β of between 30° to 50°, with 45° being and especially preferred angle β.

In a modified embodiment, provision is made so that the cylinder broom (21) is driven by one or both of the circular brooms (11, 12). Since the circular brooms (11, 12) always rotate in the same direction of rotation irrespective of the direction of travel of the sweeping machine, the cylinder broom (21) will in turn also always be driven in the "right" direction of rotation.

In yet another modified embodiment, the cylinder broom (21) and, if necessary, the circular brooms (11, 12) may be electrically motor-driven. In this case, the rotation speed of the cylinder broom (21) will not depend on the speed at which the sweeping machine is moving. An electric motorized drive may also be provided to drive the actual sweeping machine itself along, so that the sweeping machine merely has to be guided by the operator rather than be pushed or pulled.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A sweeping machine with a housing incorporating a refuse collection container, which has at its front area, rotating in opposite directions towards the inside and about forwardly inclined rotatable axles, two circular brooms sweeping across a sweeper plate inside the housing, which sweeper plate extends back up to the refuse collection container, wherein arranged behind the circular brooms is a cylinder broom sweeping in a direction towards a front area, the bristles of which cylinder broom adjoin the sweeper plate, and wherein the refuse collection container is arranged on a side of the cylinder broom facing away from the sweeper plate.

2. A sweeping machine as claimed in claim 1, wherein an essentially part-cylindrical guide wall is provided for the cylinder broom, an upper end of which guide wall adjoins an end of the sweeper plate facing towards the cylinder broom.

3. A sweeping machine as claimed in claim 2, wherein an end of the sweeper plate facing towards the cylinder broom is provided with an upwardly bent end portion oriented somewhat at a tangent to an external circumference of the bristles of the cylinder broom.

4. A sweeping machine as claimed in claim 2, wherein the guide wall extends in relation to the cylinder broom, at a circumferential angle starting from the horizontal of 30° to 50°.

5. A sweeping machine as claimed in claim 4, wherein said angle is about 45°.

6. A sweeping machine as claimed in claim 1, wherein an end of the sweeper plate facing towards the cylinder broom is provided with an upwardly bent end portion oriented somewhat at a tangent to an external circumference of the bristles of the cylinder broom.

7. A sweeping machine as claimed in claim 1, wherein a stripper blade extends relative to the cylinder broom, at a circumferential angle starting from the horizontal of 30° to 50°.

8. A sweeping machine as claimed in claim 7, wherein said angle is about 45° .

9. A sweeping machine as claimed in claim 1, wherein the circular brooms and their bristles extend beyond an end of the sweeper plate into an area of bristle edges of the cylinder broom.

10. A sweeping machine as claimed in claim 1, wherein the axial length of the cylinder broom is smaller than a distance between the rotatable axles of the circular brooms.

11. A sweeping machine as claimed in claim 10, wherein said axial length is less than 80% of the distance between the rotatable axles of the circular broom.

12. A sweeping machine as claimed in claim 11, wherein cross-walls are arranged in the area of the two end faces of the cylinder broom, which cross-walls extend in a longitudinal direction of the housing, each cross-wall being located above a circular broom.

13. A sweeping machine as claimed in claim 10, wherein said axial length is 70% of the distance between the rotatable axles of the circular brooms.

14. A sweeping machine as claimed in claim 10, wherein cross-walls are arranged in the area of the two end faces of the cylinder broom, which cross-walls extend in a longitudinal direction of the housing, each cross-wall being located above a circular broom.

15. A sweeping machine as claimed in claim 1, wherein the bristles of the cylinder broom have an operating sweeping diameter between 115 mm and 145 mm.

16. A sweeping machine as claimed in claim 1, wherein bristles of the cylinder broom consist of several tufts of bristles.

17. A sweeping machine as claimed in claim 16, wherein the tufts of bristles are formed by sets of at least two sections inclined with respect to one another to form an arrow-shape pointing toward the middle of the cylinder broom.

18. A sweeping machine as claimed in claim 1, wherein wheels are provided in an area of the housing facing away from the circular brooms, by means of which wheels the cylinder broom is driven.

19. A sweeping machine comprising:

a housing forming a refuse collection container, a sweeper plate supported in said housing in front of the refuse collection container, a pair of counterrotatable circular brooms supported in said housing for rotation about inclined axles and having circular broom bristles which in use sweep across the sweeper plate, and a cylinder broom supported in said housing behind the circular brooms and having cylinder broom bristles sweeping in use in a forward direction.

20. A sweeping machine according as claimed in claim 19, wherein transport wheels are provided on said housing, which transport wheels are operably drivingly connected to the cylinder broom.

21. A sweeping machine according to claim 19, wherein an essentially part-cylindrical guide wall is provided for the cylinder broom, an upper end of which guide wall adjoins an end of the sweeper plate facing towards the cylinder broom.

22. A sweeping machine according to claim 21, wherein an end of the sweeper plate facing towards the cylinder broom is provided with an upwardly bent end portion oriented somewhat at a tangent to an external circumference of the bristles of the cylinder broom.

23. A sweeping machine according to claim 22, wherein the guide wall extends in relation to the cylinder broom, at a circumferential angle starting from the horizontal of 30° to 50°.

24. A sweeping machine according to claim 19, wherein the circular brooms and their bristles extend beyond an end of the sweeper plate into an area of bristle edges of the cylinder broom.

25. A sweeping machine according to claim 19, wherein the axial length of the cylinder broom is smaller than a distance between rotatable axles of the circular brooms.

26. A sweeping machine according to claim 19, wherein said cylinder broom is configured to pick up refuse swept by the circular brooms and sweep up dusty refuse from the ground and throw both together backwards into the refuse collection container.

27. A sweeping machine according to claim 26, wherein transport wheels are provided on said housing, which transport wheels are operably drivingly connected to the cylinder broom.

28. A sweeping machine according to claim 27, comprising a handle connected to the housing to accommodate manual pushing of the sweeping machine.

* * * * *